US006994337B1

(12) United States Patent
Cracknell et al.

(10) Patent No.: US 6,994,337 B1
(45) Date of Patent: Feb. 7, 2006

(54) BOOK BINDERY AND TRIMMING APPARATUS

(75) Inventors: John Cracknell, Maidenhead (GB); John O'Brien, High Wycombe (GB); Martin Brewster, High Wycombe (GB); Mark Firth, Chesham Bois (GB)

(73) Assignee: IBIS Integrated Bindery Systems Ltd., Buckinghamshire (GB)

( * ) Notice: Subject to any disclaimer, the term of this patent is extended or adjusted under 35 U.S.C. 154(b) by 348 days.

(21) Appl. No.: 10/129,590

(22) PCT Filed: Nov. 10, 2000

(86) PCT No.: PCT/GB00/04313

§ 371 (c)(1),
(2), (4) Date: Sep. 6, 2002

(87) PCT Pub. No.: WO01/34403

PCT Pub. Date: May 17, 2001

(30) Foreign Application Priority Data

Nov. 11, 1999 (GB) ..... 9926734

(51) Int. Cl.
*B65H 39/00* (2006.01)

(52) U.S. Cl. ..... 270/52.29; 270/52.26; 271/192; 414/790.4; 414/798

(58) Field of Classification Search ..... 270/52.26, 270/52.27, 52.28, 52.29, 52.18; 414/798, 414/798.1, 790.4; 271/315, 213, 218, 190, 271/192
See application file for complete search history.

(56) References Cited

U.S. PATENT DOCUMENTS

| | | | | | |
|---|---|---|---|---|---|
| 1,365,741 | A | * | 1/1921 | Speer | 414/788.9 |
| 3,154,307 | A | * | 10/1964 | Williamson | 414/788.3 |
| 3,205,794 | A | * | 9/1965 | Califano et al. | 414/789.1 |
| 4,207,788 | A | * | 6/1980 | Regele | 83/89 |
| 4,384,813 | A | * | 5/1983 | Smith et al. | 414/788.3 |
| 4,506,882 | A | | 3/1985 | Ito et al. | |
| 4,938,657 | A | * | 7/1990 | Benson et al. | 414/790.4 |
| 4,976,420 | A | * | 12/1990 | Flensburg et al. | 270/52.28 |
| 4,997,337 | A | * | 3/1991 | Trimble | 414/790.4 |
| 5,005,815 | A | * | 4/1991 | Auksi | 270/1.02 |
| 5,067,700 | A | * | 11/1991 | Dick | 270/52.29 |
| 5,112,033 | A | | 5/1992 | Breton | |
| 5,595,379 | A | * | 1/1997 | Hoang | 270/52.06 |

FOREIGN PATENT DOCUMENTS

| | | | |
|---|---|---|---|
| DE | 425724 | C | 2/1926 |
| EP | 1005984 | A | 6/2000 |
| FR | 1066051 | A | 6/1954 |
| JP | 61127563 | A | 10/1986 |

* cited by examiner

*Primary Examiner*—Patrick Mackey
(74) *Attorney, Agent, or Firm*—Volpe and Koenig, P.C.

(57) ABSTRACT

Book bindery and trimming apparatus which is directly connectable to the output of a digital printer enable substantially automatic book production. Individual sheets are cut from a printed web, folded and driven into a sheet stacker. The stacker collects the sheets onto a pair of vanes mounted on respective drums until the end of a book is reached. At this point the stacker is moved to its next position(s) and the sheets forming the collected book are deposited on a stack collector. Meanwhile, a new pair of vanes present themselves for book collection. The collected book progresses through a stitcher, for wire stitching, and then to the trimming apparatus. The trimming apparatus has a book path inclined downwardly towards a backstop which, in cooperation with front stop fingers, ensures reliable alignment of the book for trimming.

10 Claims, 7 Drawing Sheets

BOOK BINDERY AND TRIMMING APPARATUS

The present invention relates to book bindery apparatus suitable for use in-line with digital printers. The present invention separately relates to book trimming apparatus that may be used alone or in combination with the book bindery apparatus.

Digital printing technology allows a printed image to be changed on each consecutive sheet supplied to the printer without stopping the printer to fit a new printing plate. This means that the sheets of a book can be printed in sequence instead of the conventional approach where a particular sheet of the book is printed the requisite number of times before going on to the next sheet and the individual sheets of the book are only subsequently collated. Digital printers are therefore able to print short and medium sized runs of printed material much more quickly and at lower costs than previously possible.

To maximise the benefits associated with continuous web feed monochrome digital presses, the need has been identified for an in-line bindery system and also an on-line trimming system. In particular, book bindery and trimming apparatus that is capable of handling around 270 sheets per minute is needed for use with current fast monochrome digital printers.

With the exception of very low speed digital printers, the output from higher speed digital presses is currently finished using a simple stand-alone binding machine that is fed by hand. The printed sheets are usually passed through a separate folder and stacked on pallets for subsequent hand feeding into the stand-alone binding machine. One known automated bindery machine is the Horizon SPF™. With this machine, the sheets from a digital printer are fed into the machine and are wire stitched together before being folded and the front edge trimmed. The Horizon SPF, however, is too slow for the operating speeds of current digital printers and is not suited to heavy duty use. Also, because of the folding method employed in the Horizon SPF, the machine is not suitable for handling books having a thickness greater than 40 A4 pages.

The present invention seeks to overcome some of the difficulties that exist with current bindery and trimming apparatus and seeks to provide bindery apparatus and separately trimming apparatus which may be used alone or in combination with one another, and are suitable for use with the new range of high speed (monochrome) digital printers and in particular can be used in-line, that is to say with the input of the bindery apparatus directly connected to the output of the digital printer. In this way, in combination with a digital printer, the present invention provides apparatus that enables books to be printed, collated, stitched and trimmed automatically, with human intervention limited to the initial programming of the print run and monitoring for any mechanical or software failures.

The present invention provides a book trimmer for use in book manufacture, the book trimmer comprising: a front edge cutter for trimming the opposite edge of the book to the book spine; a support surface for guiding the passage of a book to a predetermined cutting position; the support surface being declined such that the book approaches the cutting position under the effect of gravity.

In a preferred embodiment one or more end stops are provided for halting the passage of the book down the support surface at the cutting position. The one or more end stops are located a predetermined distance downstream from the front edge cutter for engaging the book spine when the desired trim line of the front edge of the book is aligned with the front edge cutter. Ideally, at least one of the front edge cutter and the one or more end stops is adjustable to alter the separation between the front edge cutter and the one or more end stops.

A drive member may also be provided for urging the passage of the book away from the cutting position and the drive member may be in the form of a conveyor or pair of pressure wheels.

One or more front stops adjacent and upstream of the front edge cutter may also be provided to correctly register the edge of the book which is to be cut and to prevent any 'bounce' as a book contacts the end stops. The front stops can be adjustable in position to accommodate the amount of paper to be cut off from the edge of the book. The front stops are preferably biased to project from the support surface such that the front stops are forced down by the passage of a book over the top of them and they then rise up to their original position as soon as the edge of the book has passed.

In a further aspect the present invention provides a sheet stacker for use in book manufacture, the sheet stacker comprising: a pair of hubs each having a plurality of vanes projecting outwardly therefrom; a stack collector; and drive means for controlling the rotation of the hubs such that the drive means causes the hubs to simultaneously counter-rotate a predetermined arc cyclically and wherein the vanes are arranged radially around the circumference of the hubs such that in a first position opposing vanes on the pair of hubs are arranged to receive in a stack a plurality of sheets sequentially and that at the same time in a second position opposing vanes are arranged to deliver a completed stack of sheets to the stack collector.

In a preferred embodiment the vanes project substantially tangentially to the circumference of their respective hub and wherein opposing vanes on the hubs describe an inverted V shape in the space between the pair of hubs such that the opposing vanes are arranged to receive a respective sides of a plurality of partially folded sheets. Also, each vane may have a sheet receiving section and one or more stops for aligning the sheets in a stack.

More preferably, the vanes on the hubs are radially spaced such that a third position is provided between the first and second positions in which a pair of opposing vanes supports a completed stack of sheets. With this arrangement a cover feed may be provided for placing a cover over a stack of sheets, the output of the cover feed being positioned adjacent the third position so that the cover may be placed over the top of a completed stack of sheets.

A sensor may be provided for detecting markings on the sheets indicating the final sheet of a book, the sensor being in communication with the drive means whereby the timing of the rotation of the hubs is dependent on the detection by the sensor of the final sheet.

In an alternative aspect the present invention provides book manufacturing apparatus comprising: a sheet cutter for cutting individual sheets of a book from a continuous web; a folding device for folding each sheet in half; a sheet stacker as described above for collecting the folded sheets into a stack and a book binder for binding a stack of sheets into a book.

In a further alternative aspect the present invention provides a gripper system for transporting a collated stack of sheets through a stitching operation, the gripper system comprising at least one gripper on a supporting arm and wherein the supporting arm is arranged to pivot on an axis which is substantially parallel to the direction of movement of the stack of sheets.

In a further aspect the present invention provides

In an alternative further aspect the present invention provides a control system for use in combination with the sheet stacker mentioned above, the control system comprising a sensor for identifying the last sheet of a book, the sensor being in communication with a processor that has a memory in which is stored a control algorithm for calculating, on the basis of information received from the sensor, how far the identified sheet will have moved when the sheet stacker indexes to its next position and when a stack of sheets must be removed from below the sheet stacker as a result of the operation of the sheet stacker.

Ideally, the control system monitors the position of each sheet as it passes up an infeed of the sheet stacker and automatically corrects the operation of a book stitcher and book trimmer, located downstream of the sheet stacker, in order to compensate for variations in speed of the sheets passing up the infeed.

The control algorithm may calculate the change of speed of the book stitcher necessary to process a stream of books in which the numbers of pages in each book varies without the book stitcher having to go faster than it would have to go to process a stream of books each having only two pages. In this way the control algorithm enables the book stitcher speed to change during a machine cycle whilst matching the cycle time of the book stitcher to coincide with the delivery of the next book from the sheet stacker.

The control algorithm may also enable the book stitcher to change automatically from continuous running (when operating with a small number of pages) to intermittent operation (when handling a larger number of pages), whilst still matching its cycle time to the delivery of books from the sheet stacker. This enables the book stitcher and trimmer to operate purely 'on demand'.

Thus, with one aspect of the present invention sheets are stacked on the vanes of a pair of hubs and the complete stack is then delivered to the stack collector. This enables the sheet stacker to handle the higher speeds associated with web fed digital printers as one stack of sheets is being formed whilst an earlier stack is being transported away from the collector.

In a further aspect of the present invention a collated set of sheets and a cover is transported to a stationary position for stapling using a gripper or grippers which pivot on axes parallel to the direction of movement of the sheets. This allows the centre of gravity of the gripper system to be closer to its support slide.

In an even further aspect of the present invention a bound book is transported to the site of an edge trimmer over a support surface that is downwardly inclined. This ensures that the book is reliably aligned with the front edge cutter without the need for additional joggers, over-running transport belts, or other registration devices.

The control system may include speed correction means for changing the book stitcher speed during a machine cycle whilst matching the cycle time to the delivery of a stack of sheets by the sheet stacker. In this way the book stitcher is able to process a stream of books with varying numbers of pages without having to go faster than it would have to go to process a stream of books having only two pages.

In a still further aspect of the present invention a trimmer and stitcher are arranged as part of a single integral module with the trimmer paper path arranged at an angle declined to the horizontal whereby the drive to the trimmer is connected directly to the drive components of the stitcher.

Embodiments of the present invention will now be described by way of example with reference to and as shown in the accompanying drawings, in which.

Figure 1:
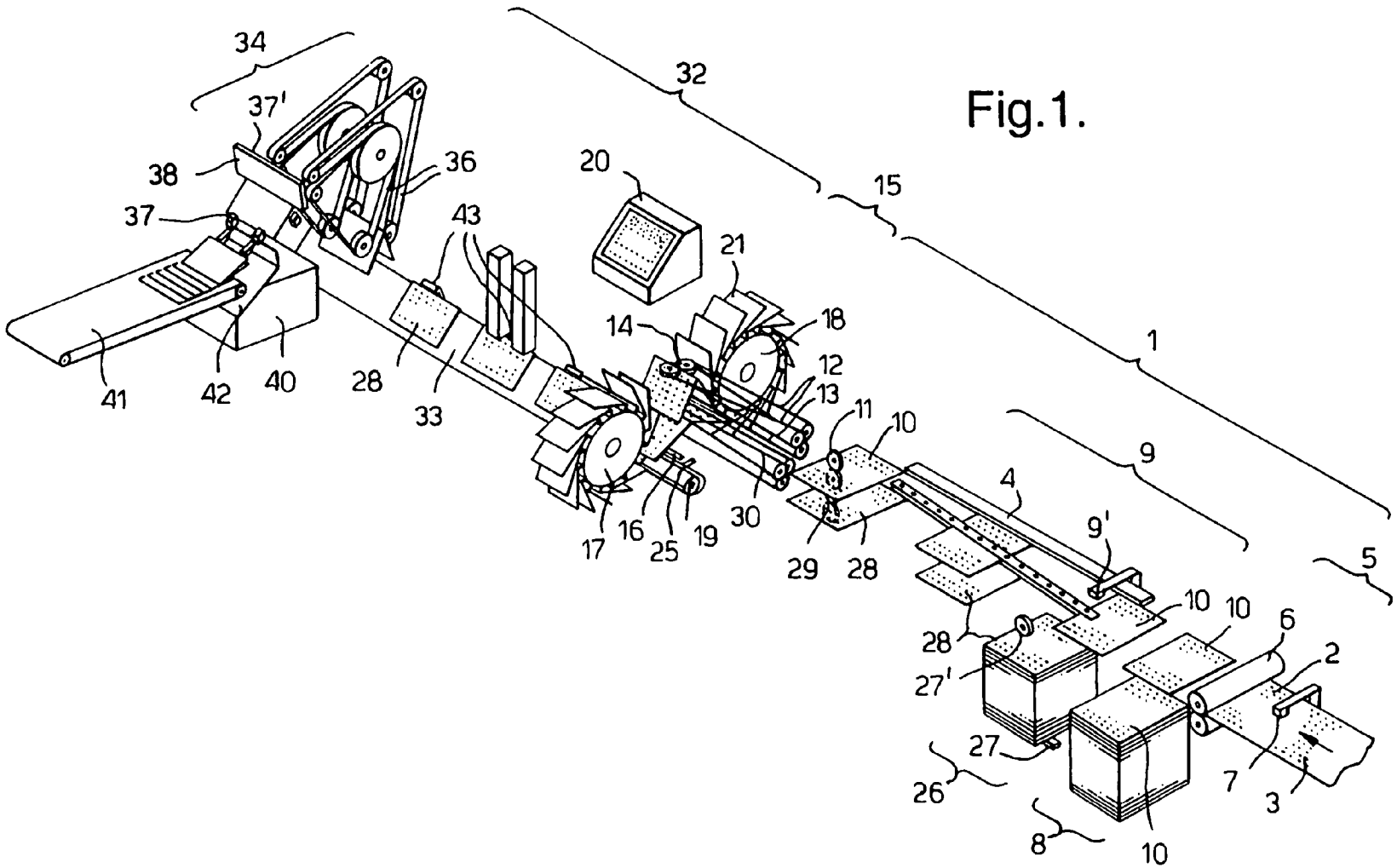
FIG. 1 is a schematic diagram of book bindery and trimming apparatus in accordance with the present invention.

With reference to FIG. 1, an in-line book binder and trimmer is shown comprising the following functional elements a sheet feeder 1, a collector 15, a cover feeder 26, a stitcher 32 and a trimmer 34. The sheet feeder 1, as shown in FIG. 1, has an input 2 that may be directly (in-line) connected to the output of a digital printer (not shown). The input 2 receives a continuous printed web 3 with two pages of the book printed across the web on both surfaces. The continuous printed web is delivered to a cutting station 5 where a cutter 6 cuts the web into individual sheets by cutting across the web. A sensor 7 is preferably located upstream of the cutter 6 to identify where each cut is to be made from markings, such as print marks or bar codes, printed on the web. A rotary cutter is particularly suitable for the cutting of the continuous web as the speed of rotation of the cutter 6 may be easily adjusted to accommodate different speeds of delivery of the web 3.

Once cut, the individual sheets 10 may be collected in a by-pass sheet stack 8 for later binding and trimming or re-feeding back into a conveyor 9. The conveyor 9 is located downstream of the cutting station 5 and moves at a faster speed than the speed of delivery of the continuous web 3. Once the individual sheets 10 have been cut, they are transferred to the conveyor 9 and because of the greater speed of the conveyor 9 this results in the sheets being separated from one another on the conveyor 9. The conveyor 9 delivers the individual sheets 10 to a pair of scoring wheels 11 positioned centrally above and below the conveyor 9. The function of conveyor 9 is to accurately register each sheet against the adjustable side guide 4 so as to position the centre of the sheet exactly in line with the scoring wheels. At the end of conveyor 9 the centre of the sheets, about which the sheets are folded, lies parallel to the direction of travel and exactly aligned with the scoring rollers. Thus, as an individual sheet 10 passes though the pair of scoring wheels a fold line is accurately scored across the centre of the sheet.

From the scoring wheels 11, the individual sheets are fed to a series of folding belts 12,13. The folding belts 12,13 are conventional in construction and arrangement and consist of two upper, side belts 12 that are downwardly angled with respect to the feed direction and a lower, central belt 13. In addition to folding the individual sheets, though, the belts are also used to drive a pair of nip wheels 14. As a sheet is carried forward by the folding belts, the side belts 12 urge the sides of the sheet inwards and downwards by virtue of the twist in the belts towards the nip wheels 14. In this manner the sheet 10 is folded in half with each side hanging down over the central belt 13. The pair of nip wheels 14 are provided immediately after the folding belts 12,13 to further define the fold in the sheet 10. The nip wheels 14 are positioned so as to engage each side of the sheet immediately adjacent the fold line and are arranged to press the sides of the sheet together.

The folded sheets 10 are then driven by the nip wheels 14 directly into the collector 15 or sheet stacker. The collector 15 allows one complete book to accumulate before indexing to the next position. The collector 15 consists of a stack collector or arm 16, lying approximately parallel to the axis of two rotating drums or hubs 17, 18 that are located above and to either side of the arm 16, see FIG. 2. The axis of each of the drums lies parallel to but to one or other side of the central line of the folded sheets and the plane of the two axes lies above the arm 16. The arm is aligned above a book conveyor or chain 19 that is driven by the stitcher 32.

Figure 2A:
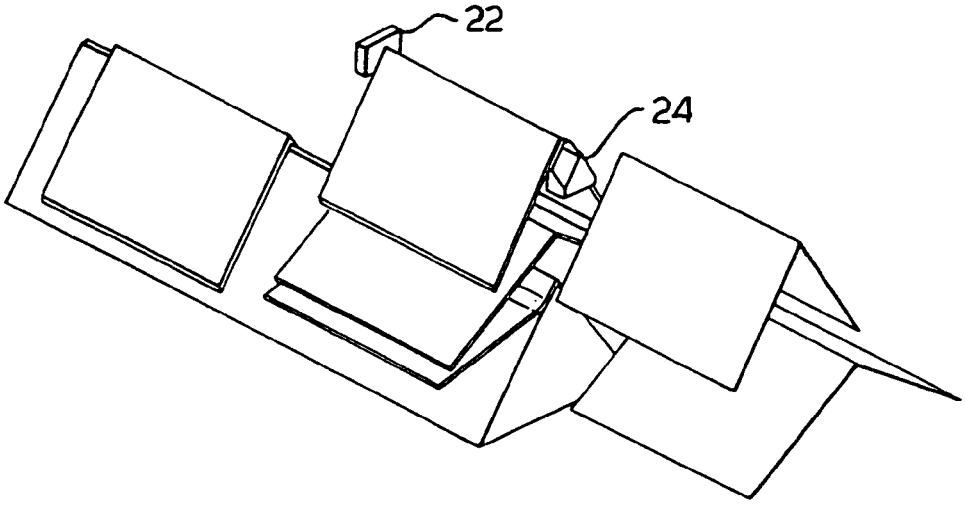
FIGS. 2A and 2B are diagrams of the collation process and the collator drums for use in the book bindery apparatus of the present invention.
Figure 2B:
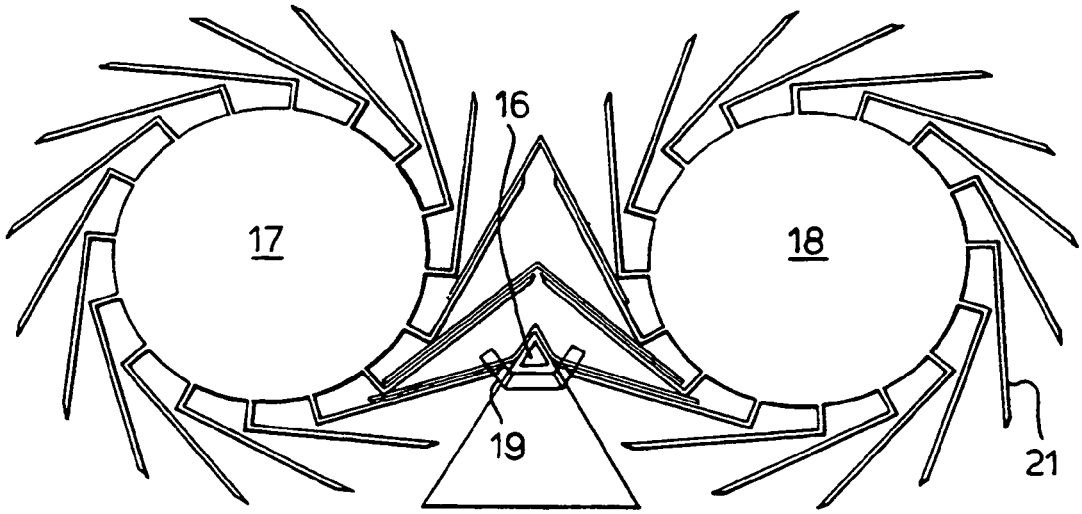
Figure 3:
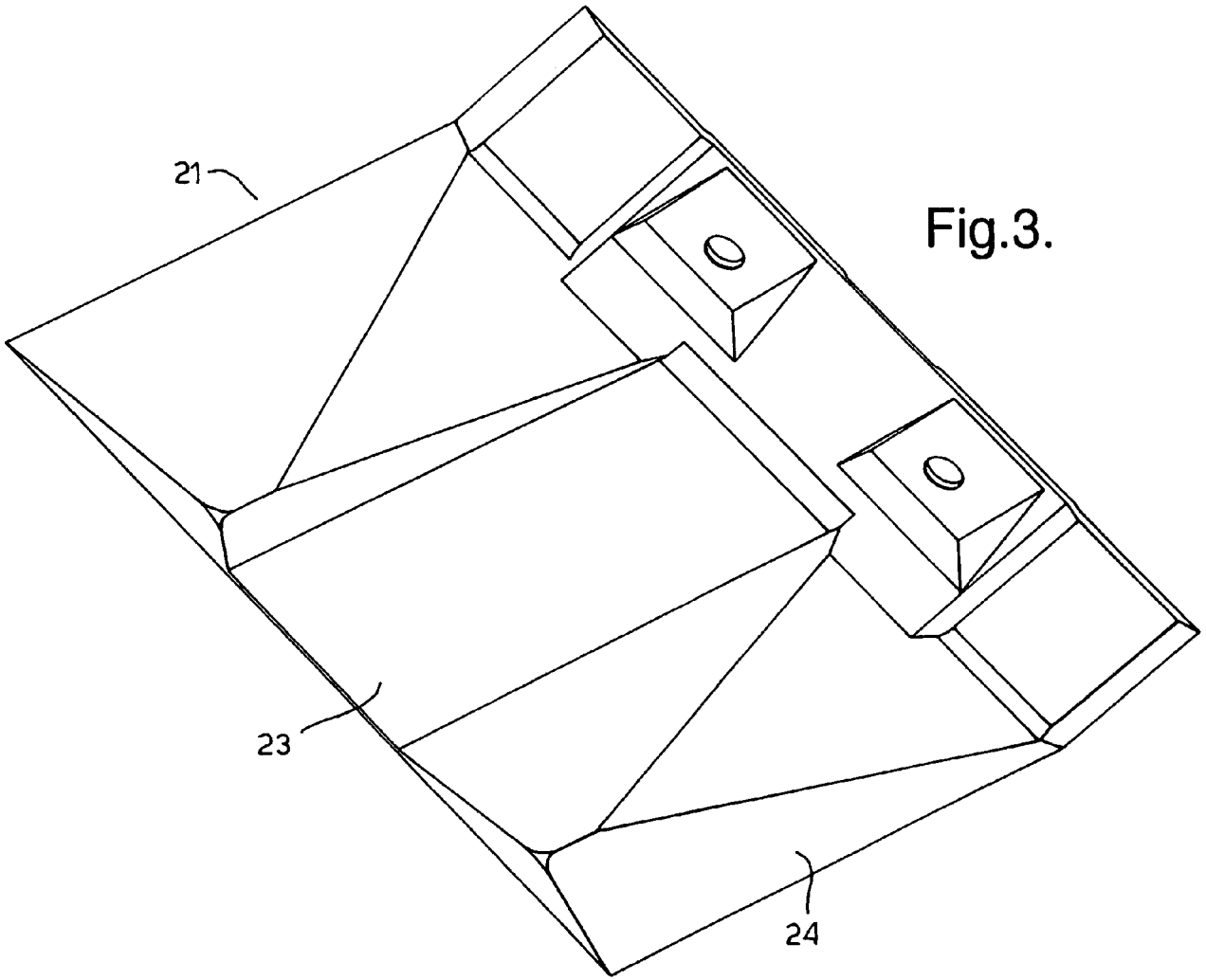
FIG. 3 is an enlarged diagram of one vane of the collator drum of FIG. 2B.

Each of the rotating drums has a plurality of outwardly extending vanes 21. As can be seen in FIG. 2, each vane 21 is attached to a central hub and then extends outwardly approximately tangentially to the circumference of the hub. The shape and construction of one of the vanes 21 is more clearly shown in FIG. 3. Each vane 21 has a central sheet receiving section 23 with sloped sides 24 to either side that act as guiding surfaces to reliably centre one side of a folded sheet in the central sheet receiving section 23. The drums are positioned so that opposing vanes on the drums approximately describe the sides of a pitched roof that is to say an upside-down 'V'. A backstop 22 locates the leading edge of each sheet as the sheet is delivered to the vanes to ensure that as the sheets are stacked on the vanes, the sheets are in register with one another. The backstop 22 is manually adjustable to accommodate different spine lengths or it may be automatically adjusted under the control of a central control unit 20.

A front stop 24 is also fitted to locate the trailing edge of each sheet as the sheet is delivered to the vanes to further ensure that as the sheets are stacked on the vanes, the sheets are in register with one another.

The rotating drums 17, 18 are arranged to counter-rotate so that the vanes on both of the drums move downwardly towards the arm 16. Thus, the drum 17, to the left in FIG. 2B, rotates clockwise whilst the drum 18, to the right in FIG. 2, rotates anticlockwise. Ideally, the rotation of both of the drums 17, 18 is driven by a single motor, via conventional gearing, (not shown) so that the counter-rotation of the two drums is synchronised, for example by a timing belt. Alternatively, the two drums may have separate drives that are linked or under the common control of the central control unit 20. The drums 17, 18 do not rotate continuously, instead the rotation of the drums is indexed so that the drums rotate a predetermined arc cyclically, as described below.

Each sheet falls under gravity from the nip wheels 14 into the sheet receiving sections 23 of opposing, stationary vanes 21 temporarily positioned, in a first position, immediately beneath the sheet with each of the folded sides of the sheet 10 falling into a respective one of the pair of vanes. The drums remain stationary as additional folded sheets follow in turn and are stacked across the same opposing vanes 21. Once all of the sheets for one book are stacked on the pair of vanes 21, the two drums rotate a predetermined arc to carry the stack of sheets down to the arm 16. Thus, the vanes 21 are indexed to their next position, a second position, below the upper edge of the arm 16; this results in the stacked folded sheets 10 being draped over the arm 16. The spacing of the vanes 21 about the hub is such that at least two stacks of folded sheets are carried by consecutive pairs of vanes at any one time. In this way, the arm 16 may be supporting a stack of sheets whilst a second stack of sheets is being supported, in a third position, on a pair of opposing vanes above the arm, waiting to be deposited on the arm 16, and a series of sheets are in the process of being stacked over a second upper pair of opposing vanes. Ideally, a complete book consists of a single stack of sheets carried by one pair of vanes. However, in an alternative, a book may be formed from a series of stacks of sheets.

A sensor 9' is positioned on the sheet conveyor 9 and is used to scan the index markings (bar codes) printed on the sheets in order to identify the last sheet of a book. When the last sheet is identified by the sensor 9', after a short delay to allow the last sheet time to be positioned on the vanes, the drums 17, 18 are indexed to their next position in which the complete stack of sheets is moved towards the arm 16 and a new pair of vanes are presented to receive a new stack of sheets.

Whilst a series of sheets are being stacked on an upper pair of vanes, an intermediate pair of vanes are supporting a completed stack of sheets in a middle position, waiting to be indexed to the next position where the stack will be deposited on the arm 16. In this arrangement the cover feeder 26, if used, is aligned with the position of the intermediate (middle) pair of vanes so that the cover can be laid over the top of the stack of sheets whilst the stack is waiting to be indexed to their next position on the arm 16.

Once all the sheets of the book (including a separately fed cover, if applicable) are in place on the arm 16, the conveyor 19 moves forward and a pusher finger 25 projecting upwardly from the conveyor 19 to above the arm 16 engages the edge of the stack of sheets and pushes the stack forward off the arm 16.

The cover feeder 26 is only required to be used when the cover to the book is in a different material, for example laminated, or is printed in colour whereas the remainder of the book is printed in monochrome. The cover feeder 26 has a lift table 27 within which individual covers 28 are stacked, outside surface uppermost. A sensor (not shown) may be used to monitor the height of the pile of covers on the table 27 and to maintain a constant height of the top of the pile of top covers. From the lift table 27 each cover is fed individually using a vacuum separation system 27' and then registered and centred with respect to a pair of scoring wheels 29. The covers are fed through the scoring wheels 29 to define a fold line for the covers. The scored covers are then fed to folding belts 30 and to nip wheels (not shown) downstream from the folding belts 30. In this way each cover 28 is folded before being introduced over the top of a stack of sheets on a pair of support vanes 21 in their middle (intermediate) position. Sensors may be used to automatically monitor the size and shape of the covers so that the score line in the cover is accurately positioned centrally to the cover. Alternatively, fine adjustment may be performed manually.

A backstop and a front stop (not shown) are used to ensure the cover registers with the stack of sheets, preferably within 0.2 mm. The backstop is adjustable so that its position may be altered to accommodate different cover lengths. Adjustment of the backstop may be performed manually or may be under the control of the central control unit 20.

Although the cover feeder 26 is shown in FIG. 1 upstream of the collector 15 it is envisaged in an alternative that the cover feeder 26 be located in between the sheet collator 15 and the stitcher. With this arrangement the folded cover is delivered to the top of the stack of sheets whilst the stack is supported by an extended version of the conveyor 19.

Figure 5A:
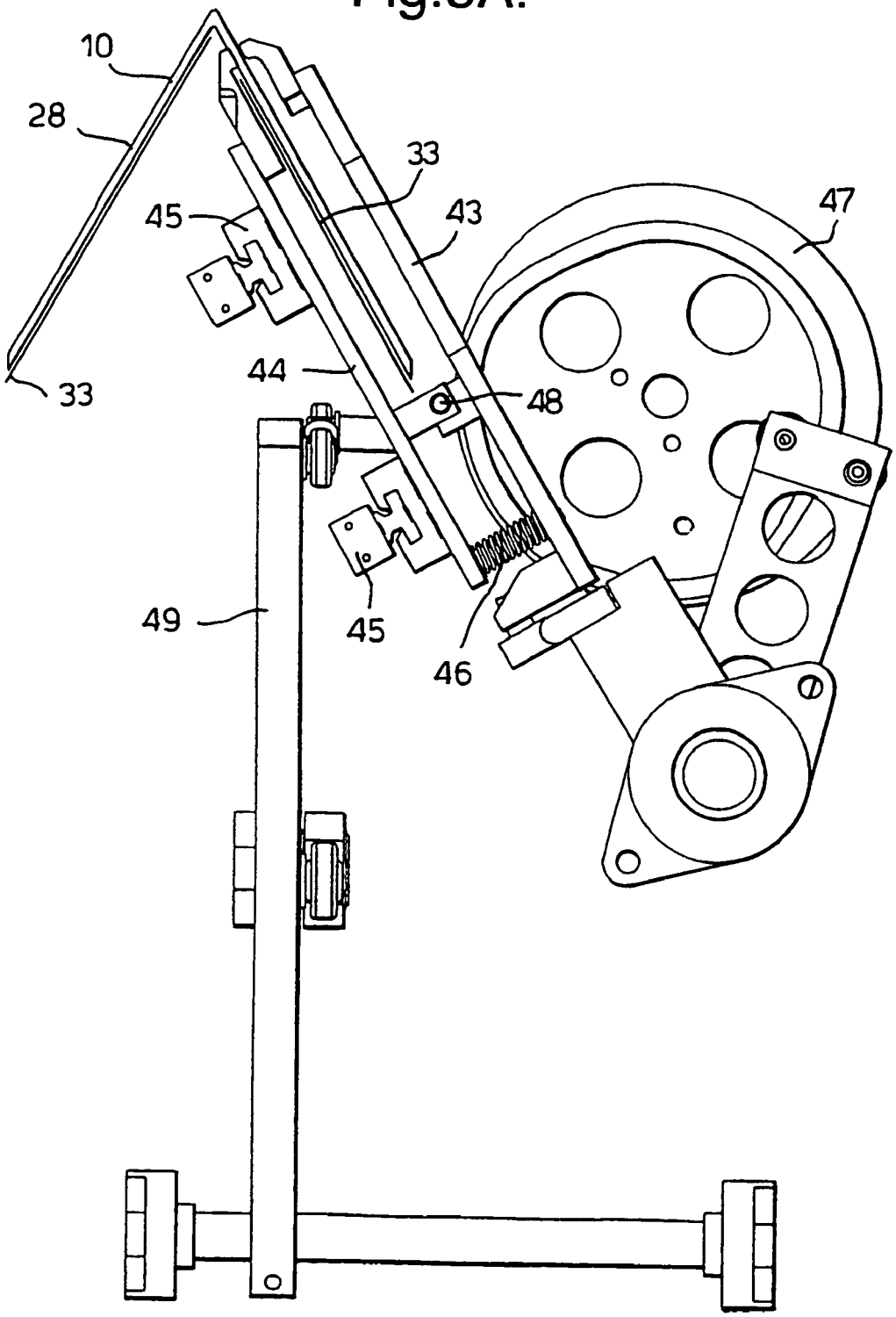
FIGS. 5A and 5B are enlarged diagrams of the stitcher gripper apparatus in accordance with the present invention.
Figure 5B:
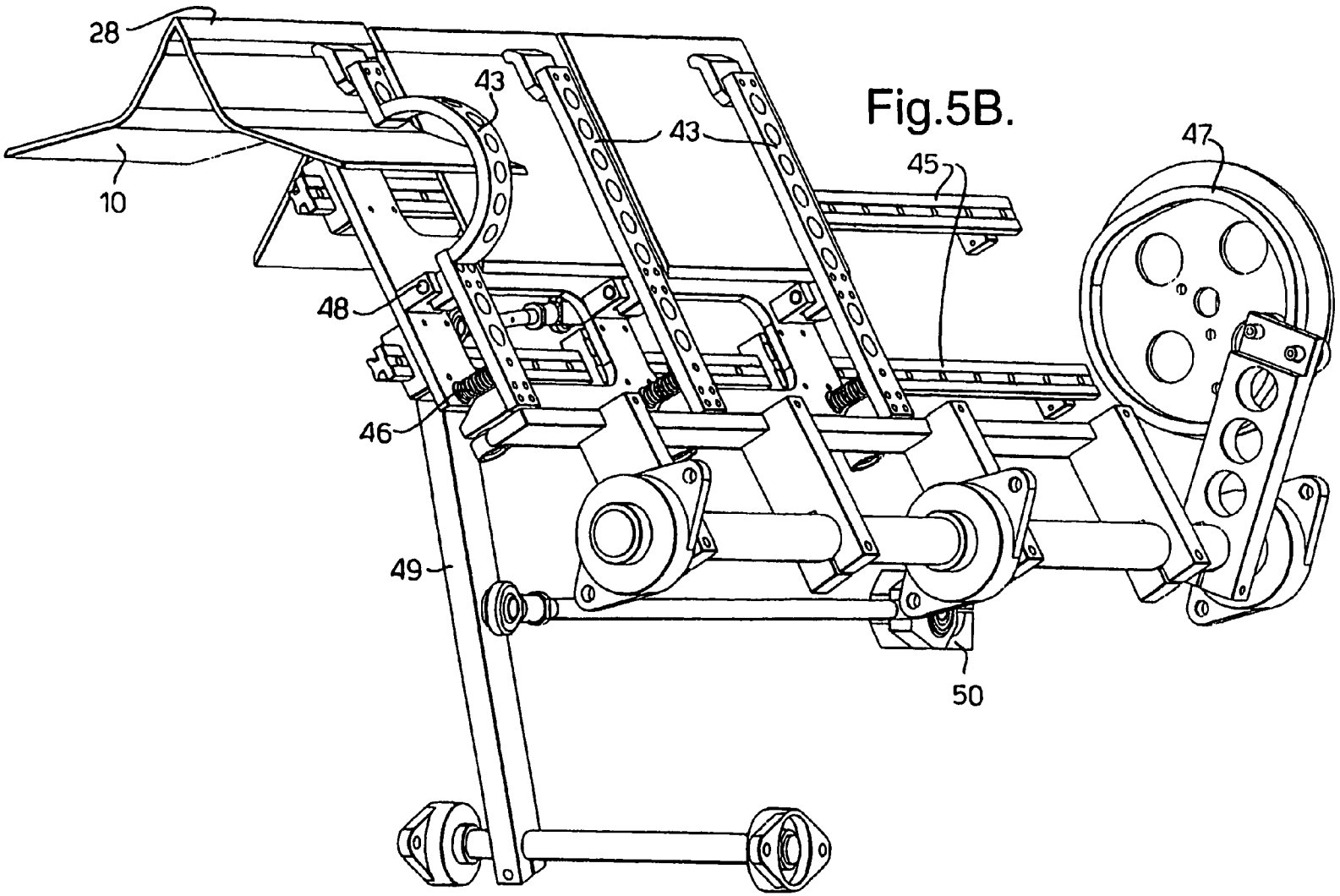

The conveyor 19 moves the completed stack of sheets and cover forward to the stitcher 32. Ideally, a shuttle gripper system is used to transport the stack of sheets through the stitcher 32. The gripper system is shown in FIGS. 5A and 5B and comprises three gripper arms 43 which pivot on axes 48 and are mounted on a support structure 44 which slides on two slide bars 45. The support structure 44 is driven backwards and forwards on the slide bars 45 by a rotary crank mechanism 50 via a motion amplifying arm 49. The upper end of each gripper arm presses against the collated sheets 10 and cover 28. The underside of the sheets 10 are supported by the support structure 44 and the saddle 33. Each gripper arm pivots on an axis parallel to the saddle 33, unlike gripper systems used on conventional products which use grippers pivoting on axes perpendicular to the saddle. Gripper arm pressure on the cover 28 is maintained by a spring 46 until the gripper arms reach the end of their forward movement, at which point a cam 47 causes the gripper arms to pivot away from contact with the sheets 10 and cover 28. Once the gripper arms 43 have pivoted to this open position they are able to move backwards along the slide bar 45 without further moving sheets 10 or cover 28. When gripper arms 43 reach their fully back position, the cam 47 allows the arms to pivot down to contact the cover 28 on a subsequent set of sheets 10 and cover 28.

The effect of the action of gripper arms 43 is firstly to move each set of sheets 10 and cover 28 forward along saddle 33 to one of three defined positions. In these positions they are then stopped for sufficient time to allow (in the first stop position) the sheets and cover to be wire stitched (stapled) or (in the third stop position) the stitched sheets and cover to be transferred up into conveyor belts 36. The second position intermediate the first and third positions is a rest position and, although not essential, is useful in so far as creating additional space for machine operator access to the stitching area.

Conventional stitching heads and wire clinchers are used to wire stitch the stack of sheets and any cover together in which a plurality of wire staples are driven downwards through the spine of the books through apertures in the saddle 33 into a wire clincher which bends the ends of the wire closed. A stitch sensor (not shown) is provided to monitor for missing stitches. Where the stitch sensor notes that a stitch has been missed, this information is fed to the central control unit 20.

Figure 4A:
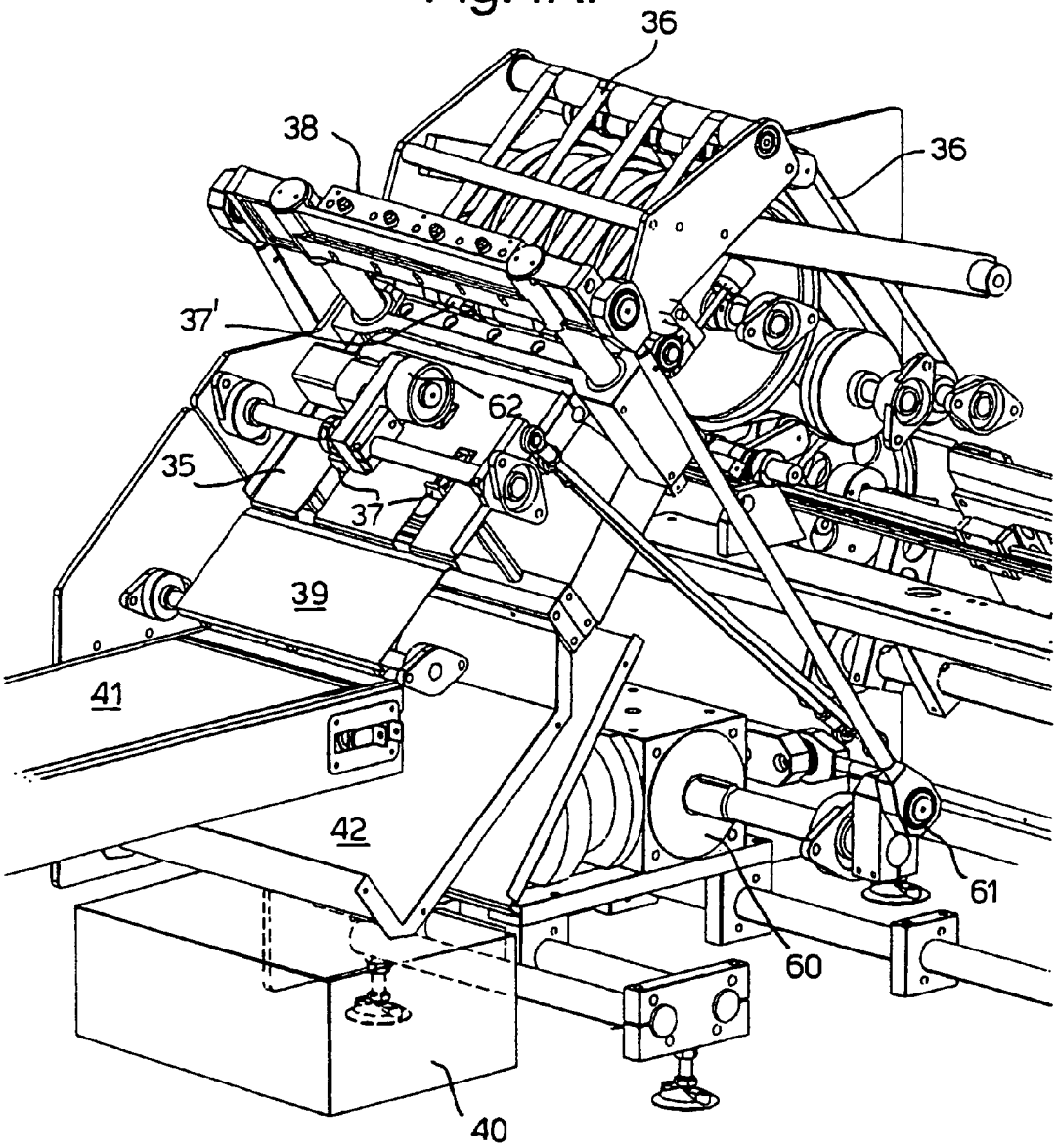
FIGS. 4A and 4B are enlarged diagrams of the book trimming apparatus in accordance with the present invention.
Figure 4B:
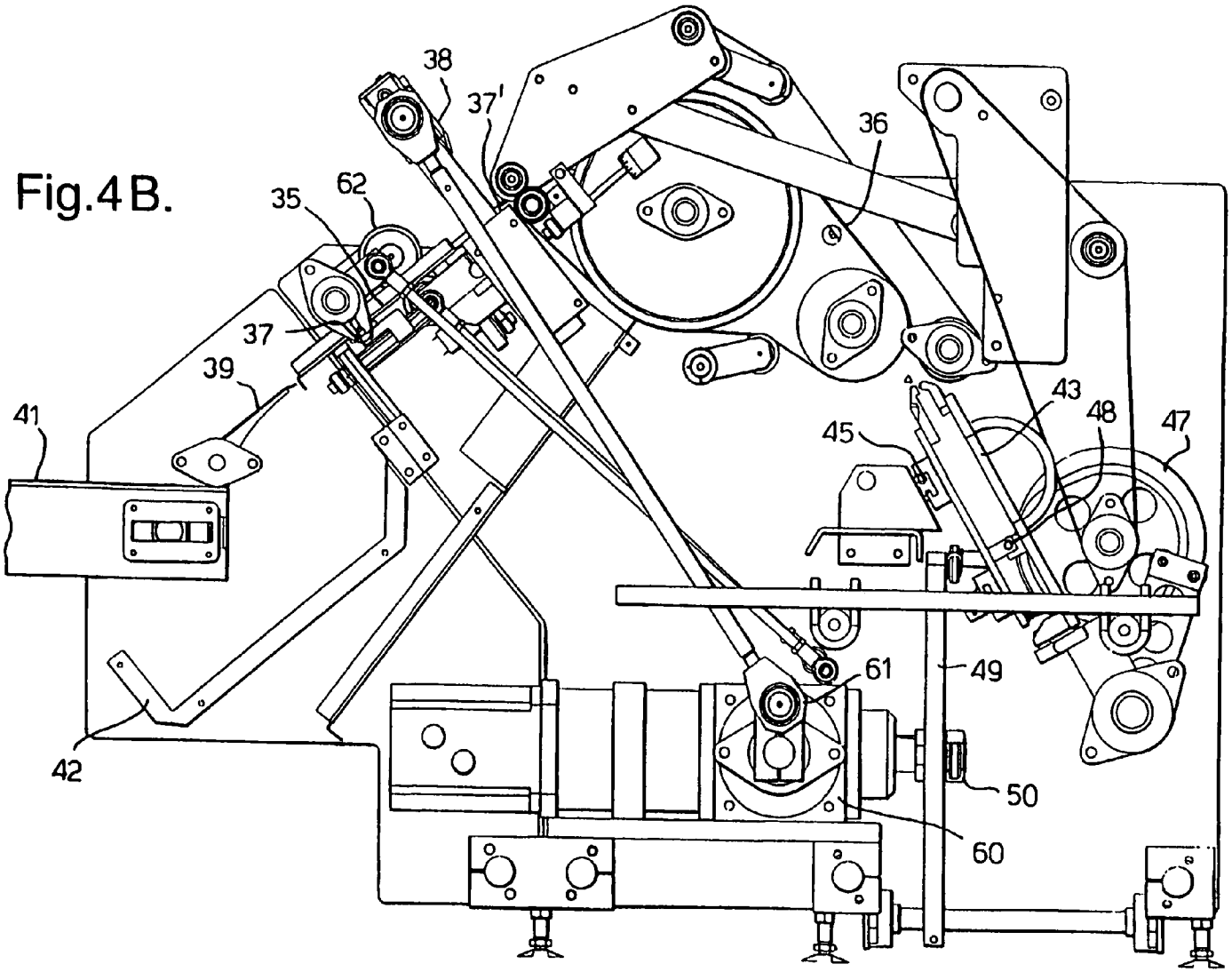

From the stitcher 32, the stitched book is transferred to a trimmer 34 as shown in FIGS. 4A and 4B. The stitched book is lifted from the saddle 33 using pushers through the apertures in the saddle and is positioned between upper and lower conveyor belts 36 with the spine of the book downstream.

The conveyor belts 36 decline at an angle, for example of 45° as they approach a front edge trimmer knife or blade 38. Beyond the conveyor belts 36 and the trimmer knife 38 a support surface 35 is provided over which the book slides. The support surface 35 is also inclined downwardly away from the front edge trimmer knife. Thus, when the conveyor belts 36 release the book it is then free to slide a short distance under the effect of gravity over the support surface 35 until the book spine rests against one or more backstops 37.

In the past difficulties have been experienced with books 'bouncing' when being abruptly stopped in their movement by a backstop. With this trimming apparatus gravity is used to help register the books against the backstop 37 and also a plurality of front stop fingers 37' are used to maintain an accurate stop position. The front stop fingers 37' are biased by means of a spring-loaded mount so as to project across the path of the book from the conveyor belts 36 to the support surface 35 so that the front stop fingers 37' come up after the book has passed in order to prevent any bounce away from the backstop 37. The front stop fingers 37' are adjustable in position according to the amount of book to be trimmed off by the knife and are preferably mounted on a track parallel to the feed direction that lies in the gap (approx. 20 mm) between the conveyors and the front edge knife.

The front edge knife 38 lies transverse to the direction of book travel and is located a predetermined distance upstream from the backstop 37 with the separation of the front edge knife from the backstop being dependent upon the desired size of the trimmed book. The front edge knife 38 cuts past a lower bed knife using a scissor action, thereby trimming off the foredge of the book. The backstops 37 are preferably mounted on a track (not shown) so that the distance of the front edge knife from the backstops can be adjusted either manually or under the control of the central control unit 20.

Additional knives (not shown) may be provided to trim the sides and the centre of the book. The waste paper from the trimming of the book falls down under gravity to a collection bin 40. Ideally, any control markings such as a bar code are printed on the foredges of the sheets of the book so that they are removed when the book is trimmed. By using gravity and the front stops 37' to register and align the book with respect to the backstop, the trim quality is assured.

The backstops 37 are movable perpendicular to the guide surface 35 so that once the foredge of the book has been trimmed, the backstops are moved below the upper surface of the support surface 35 so as to allow the book to pass. Nip wheels 62 engage the uppermost surface of the book and urge the book down to a further conveyor 41. This conveyor is moving at a much slower speed than the upstream conveyors so that the books are shingled, i.e. overlapping, on the conveyor 41. Books that are of irregular size as a result of the sheets not being registered accurately, that have an incorrect number of pages or books that have stitches missing are identified by the central control unit 20 using information from the various sensors. These books are then diverted to a separate reject collection area 42 using a divert flap 39 just after the backstops 37. The books on the conveyor 41 may be automatically spaced into predetermined quantities for the purposes of batching the books for bundling or palletising.

A consequence of the declined book path through the trimmer is that the mechanical drive to the trimmer, which includes the drive for the knives, the nip wheels and the backstops, can be taken directly from the stitcher which also controls the conveyor 19. This also makes it possible for the framework for the trimmer front edge knife becoming an extension of the stitcher framework. That is to say, the trimmer and the stitcher have a common drive that ensures both elements are synchronised at all times with each other and with the delivery of books from the stack collector. Moreover, the common drive avoids the need for complex control mechanisms and simplifies any adjustments that may be required by enabling most adjustments to be carried out only once. A central drive gearbox 60 drives both the stitcher crank arm 50, the crank arms 61 for the movement of the trimmer knife 38 and the cams required for all other reciprocating motions. Thus, the trimmer and stitcher form an integral module in which the trimmer paper path lies at an angle declined to the horizontal thereby enabling the drive to the trimmer to be connected directly to the drive components for driving the stitcher.

Although the trimmer apparatus is described as part of a complete binding and trimming apparatus it will be immediately apparent that the binding apparatus may be operated separately from the trimming apparatus and vice versa.

One of the advantages of the binder and trimming apparatus described above is that the apparatus is capable of producing small batches of books on demand. Therefore, the apparatus allows batches as small as one to be produced without wastage. Also, ideally, adjustments for different thicknesses of books and different spine lengths are automatically controlled by the central control unit 20 thereby minimising operator involvement and reducing the need for operators with specialist training. Ideally, the central control unit 20 is in communication with the digital printer to which the binding and trimmer apparatus is connected so that the central control unit is instructed in advance with the size of the individual sheets, the number of sheets in each book and the speed with which the printed web will be delivered, for example. The central control unit 20 ensures the synchronisation of each element of the apparatus. Also, the central control unit 20 which is preferably in communication with the various sensors must also be programmed to identify the markings printed on the web that can be used to indicate the number of each individual sheet within each book, for example. Also, as the central control unit 20 has data on the number of sheets to a book it is able to adjust the cycle time of the stitcher and trimmer accordingly. This means that when there are only a small number of sheets in a book the stitcher and trimmer continue moving without stopping. When there are a larger number of sheets in a book then the stitcher and trimmer stop in between one book and the next. Thus one book may be followed by another book with a different number of pages and without any break in the stream of sheets arriving at the infeed conveyor 9.

The central control unit or system 20 has a processor with a memory in which is stored a control algorithm for calculating, on the basis of information received from one or more sensors, how far an identified sheet on the infeed will have moved when the collator indexes to its next position and when a stack of sheets must be removed from below the sheet stacker as a result of the operation of the sheet stacker. Ideally, the central control unit monitors the position of each sheet as it passes up the infeed to the collator and automatically corrects the operation of the stitcher and trimmer, downstream of the collator, to compensate for variations in speed of the sheets passing up the collator infeed. Also, as mentioned above the control algorithm may calculate the change of speed of the stitcher necessary to process a stream of books in which the numbers of pages in each book varies without the book stitcher having to go faster than it would have to go to process a stream of books each having only two pages. In this way the control algorithm enables the book stitcher speed to change during a machine cycle whilst matching the cycle time of the book stitcher to coincide with the delivery of the next book from the collator.

The control algorithm may also enable the stitcher to change automatically from continuous running (when operating with a small number of pages) to intermittent operation (when handling a larger number of pages), whilst still matching its cycle time to the delivery of books from the collator. This enables the book stitcher and trimmer to operate purely 'on demand'.

With the binding and trimming apparatus described above a continuous printed web can be cut into sheets, stacked, stitched and trimmed to form a finished book on a single in-line system that is capable of operating at the higher speeds of digital monochrome presses. As the collector 15 pre-stacks the sheets on a pair of vanes which are capable of indexing to their next position within the time taken between the arrival of one sheet and the next once the stack is complete, instead of stacking the sheets one by one directly on a saddle for example, the sheets can be collated at much greater speeds than has previously been the case. Also, as the trimmer apparatus has a book path inclined downwardly towards a backstop, the book is fed to the foredge knife under gravity and this ensures reliable alignment of the book with the backstop for trimming, without requiring complex upper belt pressure adjustments common with other trimmer designs.

Alterations and additions to the embodiments described above are envisaged without departing from the scope of the invention identified in the accompanying claims. For example, a 'V' belt may be used to fold the sheets in half. Also, the vanes may be arranged such that they are transported by a pair of opposing belts or chains which follow an oval instead of circular path. The principle remains that at any one time there is one pair of vanes to receive the individual sheets and a second (or third) pair of vanes to deliver a complete stack of sheets to a stack holder such as a saddle. With this alternative design of collector the vanes are still able to handle a high speed continuous feed of sheets from the folding belts by stacking the sheets across a pair of vanes whilst an earlier stack of sheets is being cleared from the arm or other stack collector.

What is claimed is:

1. A sheet stacker for use in book manufacture, the sheet stacker comprising:

a pair of hubs each having a plurality of vanes projecting outwardly therefrom;

a stack collector; and drive means for controlling the rotation of the hubs such that the drive means causes the hubs to simultaneously counter-rotate a predetermined arc cyclically and wherein the vanes are arranged radially around the circumference of the hubs such that in a first stopped position opposing vanes on the hubs are arranged to describe an inverted V shape between said hubs and in said stopped position to receive in a stack a plurality of pre-folded sheets sequentially, opposing vanes receiving a respective side of each sheet, and that at the same time in a second stopped position opposing vanes are arranged to deliver a completed stack of pre-folded sheets to the stack collector.

2. A sheet stacker as claimed in claim 1, each hub having at least three vanes and wherein the vanes project substantially tangentially to the circumference of their respective hub.

3. A sheet stacker as claimed in claim 1, wherein each vane has a sheet receiving section and one or more stops for aligning the sheets in a stack.

4. A sheet stacker as claimed in claim 1, wherein the vanes on the wheels are radially spaced such that a third position is provided between the first and second positions in which a pair of opposing vanes supports a completed stack of sheets.

5. A sheet stacker as claimed in claim 4, further including a cover feed for placing a cover over a stack of sheets, the output of the cover feed being positioned adjacent to the third position and having one or more pushers to guide the cover over the top of a completed stack of sheets.

6. A sheet stacker as claimed in claim 1, wherein the sheet collector has a substantially triangular cross-section.

7. A sheet stacker as claimed in claim 6, wherein the sheet collector is a stitch saddle.

8. A sheet stacker as claimed in claim 1, further comprising an upstream sensor for detecting markings on the sheets indicating the final sheet of a book, the sensor being in communication with the drive means whereby the timing of the rotation of the hubs is dependent on the detection by the sensor of the final sheet.

9. Book manufacturing apparatus comprising:

a sheet cutter for cutting individual sheets of a book from a continuous web;

a folding device for folding each sheet in half;

a sheet stacker as claimed in claim 1 for collecting the folded sheets into a stack and a book binder for binding a stack of sheets into a book.

10. Book manufacturing apparatus as claimed in claim 9 further comprising a gripper system for transporting a stack of sheets, the gripper system having at least one gripper arm arranged to pivot about an axis which is substantially parallel to the direction of movement of the stack of sheets.

* * * * *